US005598137A

United States Patent [19]

Alber et al.

[11] Patent Number: 5,598,137

[45] Date of Patent: Jan. 28, 1997

[54] COIL FOR HIGH-VOLTAGE TRANSFORMER

[75] Inventors: Friedrich Alber, Koengen; Rudolf Dedelmahr, Aichtal; Siegfried Kromer, Kirchheim; Hans Schott, Lenningen; Siegfried Weiss, Bissingen, all of Germany

[73] Assignee: Siemens Aktiengesellschaft, München, Germany

[21] Appl. No.: 295,762

[22] PCT Filed: Mar. 5, 1992

[86] PCT No.: PCT/DE92/00189

§ 371 Date: Sep. 26, 1994

§ 102(e) Date: Sep. 26, 1994

[87] PCT Pub. No.: WO93/18528

PCT Pub. Date: Sep. 16, 1993

[51] Int. Cl.[6] ..... H01F 27/28

[52] U.S. Cl. ..... 336/223; 336/60; 336/205; 336/207; 336/208; 335/300

[58] Field of Search ..... 335/300; 336/60, 336/205, 207, 208, 223, 232, 196, 192

[56] References Cited

U.S. PATENT DOCUMENTS

| | | | |
|---|---|---|---|
| 2,355,560 | 8/1944 | Roberds | 175/356 |
| 2,863,130 | 12/1958 | Gray et al. | 336/207 |
| 2,963,669 | 12/1960 | Salisbury | 336/192 |

FOREIGN PATENT DOCUMENTS

| | | |
|---|---|---|
| 2228281 | 11/1974 | France . |
| 1102910 | 3/1961 | Germany . |
| 2628524 | 12/1977 | Germany . |
| 2736092 | 2/1979 | Germany . |
| 3100419 | 7/1982 | Germany . |
| 3917212 | 11/1990 | Germany . |
| 52-68921 | 8/1977 | Japan . |
| 55-120116 | 12/1980 | Japan . |
| 58-145110 | 11/1983 | Japan . |
| 0640624 | 7/1950 | United Kingdom . |
| 0852909 | 11/1960 | United Kingdom . |

*Primary Examiner*—Michael L. Gellner
*Assistant Examiner*—G. R. Lord
*Attorney, Agent, or Firm*—Kenyon & Kenyon

[57] ABSTRACT

In order to achieve improved mechanical properties for a coil (1), it is proposed to structure a first electroconductive winding (3) of the coil (1) as a coil former. This coil has a first connecting element (15), to which a second connecting element (17) is attached via an insulating part (25). The two connecting elements (15, 17) form the connections for the coil (1). In this way, a self-supporting coil structure is achieved. The coil (1) is particularly intended as an under-voltage winding with a low number of windings for cast resin transformers.

20 Claims, 2 Drawing Sheets

COIL FOR HIGH-VOLTAGE TRANSFORMER

BACKGROUND OF THE INVENTION

The present invention relates to a coil, particularly for a high-voltage transformer, in which a first electroconductive winding is designed as a coil former.

DE-OS 39 17 212 discloses a transformer coil in which a wire winding is applied to a winding element of non-magnetic metal. The winding element is structured as a sleeve having a slit that passes axially through it. The winding start of the coil is electrically connected with the winding element, where a front end projection of the winding element serves as the electrical connection for the winding start of the coil. This winding arrangement is preferably cast into a cast mass, where a second connecting element cast into this is electrically connected with the winding end of the coil. This solution is only suitable for low-output transformers, e.g., for small transformers.

DE 27 36 092 A1 discloses a coil for a high-tension transformer in which a first electroconductive winding has a first connecting element. A second connecting element is attached to the first connecting element via an insulating portion. The second connecting element is also connected to a second electroconductive wiring that is insulated with respect to the first winding. Here, the windings are produced from rigid circuit boards which are each self-supporting. This type of coil and winding structure is only suitable for such high currents at which the necessary conductor material is already self-supporting by itself, due to the conductor cross-section.

Patent Abstracts of Japan, Vol. 1, No. 133 (E-77) (6162), Nov. 4, 1977, JP-A-52 068 921, discloses an internal connection part for a winding which is inserted into an axial slit of an insulating coil former as an intermediate piece.

Despite these known transformers there is still a need for a high voltage transformer with a winding designed as a coil former.

SUMMARY OF THE INVENTION

The present invention provides a coil that is suitable for use at higher output and also provides a means for forming a suitable coil former.

The coil of the present invention is particularly Suited to a high-tension transformer having two electroconductive windings insulated from one another. The first winding has a first connecting element. A second connecting element is attached to the connecting element via an insulating member. The second connecting element is electrically connected to the second electroconductive wiring. The first winding is structured as a cylinder with an axial slit into which an insulating part is inserted. The second winding is carried by the first winding in an insulated manner. At high output, high forces occur between the connecting elements of the coil, which result in repulsion of the connecting elements. With the embodiment according to the present invention, a coil is provided in which the coil former and the connecting elements form a rigid component. In this way, a special coil former can be eliminated, since the first winding is self-supporting.

It is particularly advantageous if the coil is formed of only a few windings, such as in high-power coils for smelting ovens, for example.

The connecting elements are preferably attached to the windings at a frontal end thereof. In this way, the coil obtains a compact structure. The windings of the coil can be arranged radially between two connecting elements. In this manner, an advantageous mechanical arrangement is provided in which the repulsion forces between the connection elements or the outgoing lines can be better controlled.

In advantageous manner, the windings of the coil are wound from a strip conductor. In this way, uniform force and current distribution over the entire coil width is provided. The first winding of the coil, structured as a cylinder with an axial slit is of a non-magnetic material. The insulating part inserted into the slit increases the mechanical strength of the coil. An additional increase can be achieved if the insulating piece has teeth or grooves which attach it in the slit.

In a preferred embodiment, the coil is formed as an undervoltage winding of a transformer.

In addition, if there are a plurality of windings they may be concentrically arranged, separated by cooling channels formed by spacers. The plural windings can also be parts of a common winding.

As a further aspect of the present invention an insulating part for the transformer mechanically connects two adjacent points of the winding in an electrically insulated manner to form a coil former. The part ends without extending beyond a surface of the first winding on its side facing the other outside windings. In this way, simple means to form a coil of the type described above are available. Combinations with an embodiment of the coil according to the invention or partial characteristics of it are possible in advantageous further developments.

BRIEF DESCRIPTION OF THE DRAWINGS

The present invention and other advantages will be explained below on the basis of an embodiment and the drawing.

DETAILED DESCRIPTION

Figure 1:
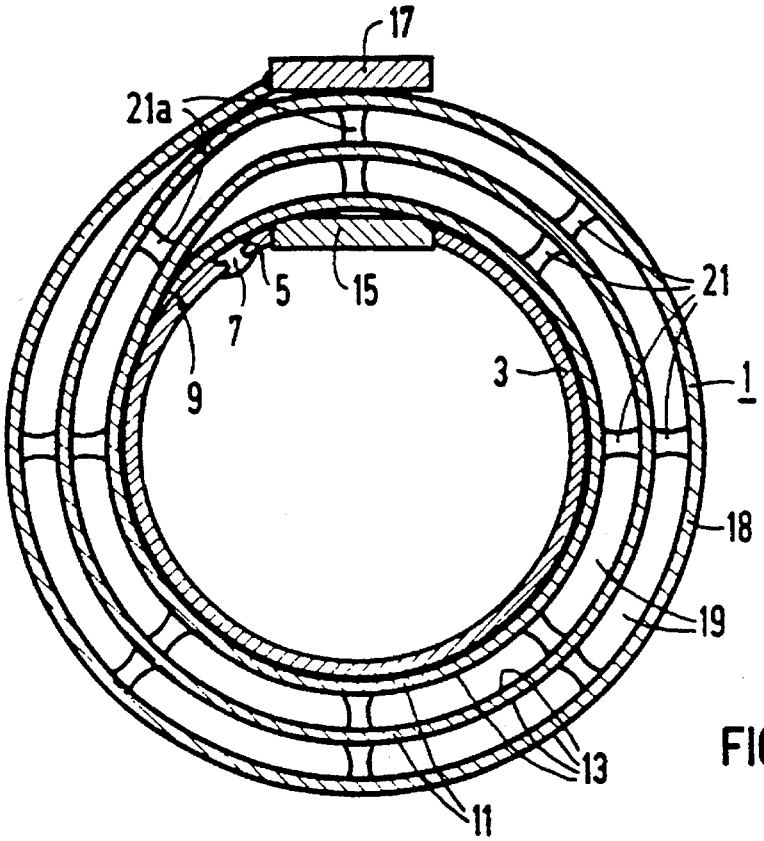
FIG. 1 illustrates a coil according to an embodiment of the present invention in cross-section.

FIG. 1 shows a coil 1, particularly a transformer coil, in cross-section. Its first electroconductive winding 3 or partial winding is structured as a coil former. For this purpose, it is produced from a mechanically stable, non-magnetic material, e.g., an aluminum alloy, and structured as a cylinder with an axial slit 5. To increase its stability, an insulating part 7 is inserted into the axial slit 5. This can be inserted into the slit 5 with teeth or a groove and spring connection, for example. To achieve advantageous guidance of the conductor, the insulating part should end level with the first winding on the side facing the further outside windings.

At the predetermined point 9 of the first winding 3, the conductor material for the further windings 11 is electrically connected with the first winding 3. The further windings 11 are surrounded by the insulating part 13 and are supported by the first winding 3. The first winding 3 has a connecting element 15. A second connecting element 17 is attached to this connecting element 15 via an insulating part 25 (see FIGS. 2 and 3). This is electrically connected with a second winding 18 with the other end of the coil formed by the windings 11. In this connection, the windings 11, 18 are arranged between the two connecting elements 15, 17. In a simple case, the coil 1 can consist of only two windings, namely of the first and the second.

Between the individual windings 11, 18, cooling channels 19 are arranged concentrically by sectors. These are formed by inserts or spacers 21, which are inserted between the individual windings 11, 18. The transition of the conductor from one winding layer to the next occurs between two inserts 21*a*. The conductor for the further windings 11 can be chosen as desired. Preferably, however, a strip conductor is used.

Figure 2:
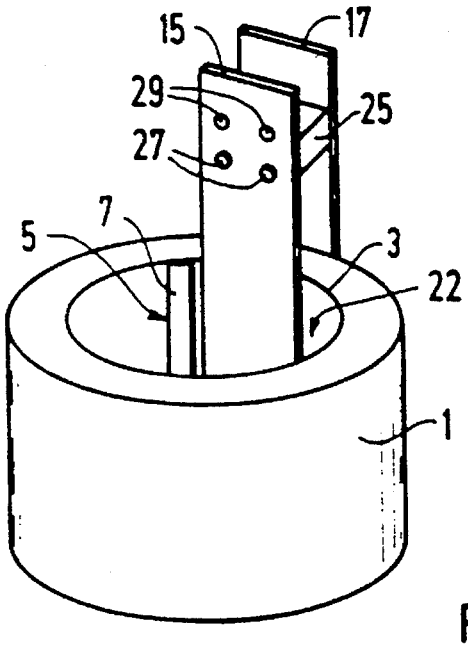
FIG. 2 shows a coil of FIG. 1 in an outside view.

FIG. 2 shows an outside view of the coil 1 to illustrate it more clearly. Here again, the first winding 3 structured as a slit cylinder can be seen, with the windings 11, not shown in further detail, arranged on it. The first connecting element 15 is electrically connected with the first winding 3. This can be structured as a rail made of a flat material, for example, which can be welded onto the first winding 3 at its frontal end, or, as shown, flat to the inside of the first winding 3. The insulating part 25 is arranged between the two connecting elements 15 and 17. This can be cast together with the connecting elements 15, 17, for example, or it can be mechanically attached to them by means of screws 27. The connecting elements 15, 17 have holes to attach electrical lines. With these developments, a coil is formed in which the coil former and the windings form a self-supporting component which furthermore takes up very little space.

Figure 3:
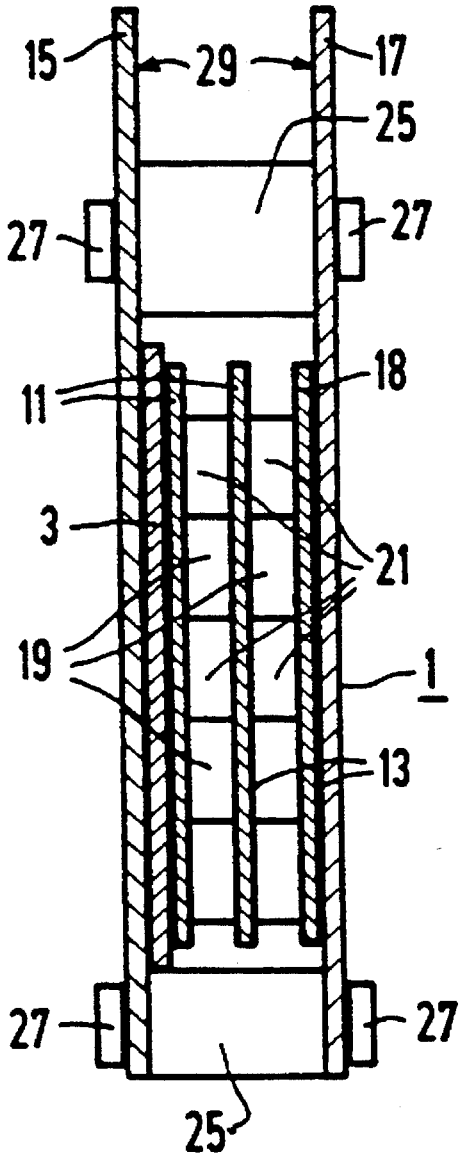
FIG. 3 shows a longitudinal cross-section through the coil of FIG. 1 in the region of its connecting elements.

FIG. 3 shows the coil in longitudinal cross-section in the region of its connecting elements 15, 17. The windings of the coil 1 can also be formed by several disk coils which are wired together.

In this representation, it is evident that an insulating part 25 is inserted between the connecting elements 15 and 17 at both ends of the coil 1. In this manner, a mechanically stable structural unit is formed by the connecting elements 15 and 17, in combination with the first winding 3 structured as a coil former, which unit also withstands high repulsion forces. In addition, however, this design also allows the coil to be arranged on a transformer core, particularly over other insulating parts, with great mechanical stability. This is particularly true for electrical outgoing lines which are connected to the connecting elements 15 and 17. In this connection, the connecting elements 15, 17 serve as support elements for the outgoing lines and for the coil 1 itself.

The inserts 21 which form the cooling channels 19 can extend over the entire length of the coil, or they can be inserted by segments, as shown. Greater cooling output is achieved with this design. To increase the stability of the coil 1, the inserts 21 of the individual layers are arranged radially above each other in each instance.

Preferably, the coil 1 is used as an undervoltage winding for cast resin transformers. Casting is possible. In particular, low numbers of windings less than 20, particularly less than 10 windings, are used for the coil for high currents. This relates to high-tension transformers, for example. For thermal reasons, cooling channels are provided. As compared with previous embodiments, no additional space has to be provided for a coil former, or for the outgoing lines of the conductors. Embodiments with very few windings can be produced with improved stability as compared with previous embodiments.

Preferably, the first winding 3 is structured to be axially longer than the subsequent windings 11. In this way, the coil can be supported axially and radially on the transformer core, via insulating parts.

What is claimed is:

1. A coil, particularly for a high-tension transformer comprising:

a first electroconductive winding;

a first connecting element;

a second connecting element;

an insulating member attaching said first connecting element to said second connecting element; and a second electroconductive winding arranged in insulated manner relative to the first winding and electrically connected to said second connecting element, wherein:

said first winding forms a cylindrical former having an axial slit, an insulating part is inserted into said axial slit, and said second winding is carried by the first winding in an insulated manner.

2. The coil of claim 1, wherein said first and second elements are arranged on a frontal end of said windings.

3. The coil of claim 2, wherein the windings are wound from a strip conductor.

4. The coil of claim 2, wherein the connecting elements serve as support elements.

5. The coil of claim 2, wherein said windings are concentrically arranged and are separated from one another by cooling channels formed by spacers.

6. The coil of claim 2, wherein said windings are parts of a common winding.

7. The coil of claim 2, wherein said windings are arranged between said first and second connecting elements.

8. The coil of claim 7, wherein the connecting elements serve as support elements.

9. The coil of claim 7, wherein said windings are concentrically arranged and are separated from one another by cooling channels formed by spacers.

10. The coil of claim 7, wherein the windings are wound from a strip conductor.

11. The coil of claim 1, wherein the windings are wound from a strip conductor.

12. The coil of claim 11, wherein the connecting elements serve as support elements.

13. The coil of claim 11, wherein said windings are concentrically arranged and are separated from one another by cooling channels formed by spacers.

14. The coil of claim 1, wherein said windings are parts of a common winding.

15. The coil of claim 1, wherein the connecting elements serve as support elements.

16. The coil of claim 15, wherein said windings are concentrically arranged and are separated from one another by cooling channels formed by spacers.

17. The coil of claim 1, wherein said windings are concentrically arranged and are separated from one another by cooling channels formed by spacers.

18. The coil of claim 17, wherein said windings are parts of a common winding.

19. The coil of claim 1, wherein coils formed by the windings serve as transformer coils.

20. An insulating part of a coil of a high-tension transformer that has a first winding forming a coil former and at least one outside winding, said coil former having an axial slit, wherein said insulating part comprises:

a central portion disposable in said slit and mechanically joining two adjacent points of the first winding at said slit in an electrically insulated manner, and an outer surface facing the at least one outside winding and being substantially flush with an outer surface of the first winding.

* * * * *